US005239708A

United States Patent [19]

Irwin

[11] Patent Number: 5,239,708

[45] Date of Patent: Aug. 31, 1993

[54] PNEUMATIC WASTE LINE CLEAN-OUT TOOL

[76] Inventor: Lawrence F. Irwin, 10835 Bellagio Rd., Los Angeles, Calif. 90027

[21] Appl. No.: 886,769

[22] Filed: May 21, 1992

[51] Int. Cl.[5] ..... E03D 9/00

[52] U.S. Cl. ..... 4/255.03; 4/255.08

[58] Field of Search ..... 4/255.01, 255.02, 255.03, 4/255.04, 255.05, 255.12, 255.06, 255.07, 255.08, 255.09, 255.1, 255.11; 251/353

[56] References Cited

U.S. PATENT DOCUMENTS

| | | | |
|---|---|---|---|
| 1,998,902 | 4/1935 | Mattich | 4/255.02 |
| 2,300,319 | 10/1942 | Smith | 4/255.01 |
| 2,386,870 | 10/1945 | Lawton | 4/255.03 |
| 2,707,000 | 4/1955 | Peeps | 251/353 |
| 2,999,264 | 9/1961 | Stearns | 4/255.01 |
| 4,053,955 | 10/1977 | Canham | 4/255.03 |
| 4,542,543 | 9/1985 | Irwin | 4/255.02 |

*Primary Examiner*—Henry J. Recla
*Assistant Examiner*—Charles R. Eloshway
*Attorney, Agent, or Firm*—J. E. Brunton

[57] ABSTRACT

A mechanically operated pneumatic cleanout tool for clearing blockages in waste lines. The tool, which is readily adaptable for use in wash basins, bath tubs, toilets, bidets and the like embodies a novel safety pressure relief valve which prevents hazardous failure of the device in the event that excessive pressure is inadvertently builtup within the air chamber of the device.

18 Claims, 8 Drawing Sheets 18
20
32
24
30
34
11
8
74
35
70
14b
16
22
66
12
102
14
14a
14c
15
45
50
58
44
56
54
42
48
52
62a
48a
62
36
26a
27
40
28
26
9
76a
76c
71
73
76
76b
78
76d
72
70a 36
27
40
26
28
20
12
24
32
18
30
16
14a
70
35
74
83
15
66
17
102
45
50
58
77
16
44
54
14
48
42
14a
62a
48a
62
81
64
66
79
85

PNEUMATIC WASTE LINE CLEAN-OUT TOOL

BACKGROUND OF THE INVENTION

1. Field of the Invention

The present invention relates generally to waste line cleanout tools. More particularly the invention concerns a pneumatic device which will generate a blast of air against backed up water in a clogged waste line tending to break loose the blockage in the line.

2. Discussion of the Prior Art

Various types of tools have been suggested for clearing stoppages in clogged drains or waste lines. Many of these tools embody plungers, reciprocating pistons or suction devices which are adapted to create water or air pressure within the clogged line to attempt to clear the blockage. These devices are often cumbersome, difficult to use and frequently fail to generate sufficient pressures upon the blockage to clear the line or, could under circumstances of a severe blockage, cause a back pressure sufficient to create a hazard to the operator.

Certain types of prior art clean-out tools have been designed to create a shock wave, or shock reaction, in the water in the clogged line to attempt to loosen the blockage. One of the most effective of these devices is described in U.S. Pat. No. 4,542,543 issued to the present applicant. The patents cited in this patent serve to illustrate the novelty of the device of the present application. Other of the prior art devices include means for also exerting a water pressure on the blockage in addition to a shock reaction. Exemplary of this type of apparatus is that disclosed in U.S. Pat. No. 4,053,955 issued to Canham. This device uses an electromagnetic unit to create an anvil-type of striking action against a piston to cause the shock reaction.

SUMMARY OF THE INVENTION

It is an object of the present invention to provide a simple, easy to use, non-electric, mechanically operated pneumatic clean-out tool for clearing blockages in waste lines.

Another object of the invention is to provide a tool of the aforementioned character which is compact, sturdy, highly reliable and readily adaptable for use in wash basins, bath tubs, toilets and bidets as well as in other types of household and industrial waste line inlets.

A further object of the invention is to provide a tool of the type described which embodies a novel safety pressure relief valve which prevents hazardous failure of the device in the event that excessive pressure is inadvertently built up within the air chamber of the device.

Another object of the invention is to provide a tool as described in the preceding paragraphs which is of an elongated configuration making it easy to use in tight quarters and at the same time uniquely configured to place the operator at a substantial distance from the drain inlet thereby minimizing operator exposure to unpleasant sewer debris and odors.

Still another object of the invention is to provide a clean-out tool of the class described which is inexpensive, light-weight and can be easily operated by a person of small stature not having great physical strength.

Another object of the invention is to provide a pneumatic device which is provided with a plurality of uniquely-shaped, readily interchangeable drain-opening seal adapters that enable the device to be used with wash basins and other fixtures of varying design and configuration. Even in those situations wherein permanent basin pop-up drain stoppers are installed in the basin, the device of the invention can readily be used without any basin disassembly being required.

DESCRIPTION OF THE INVENTION

Figure 1:
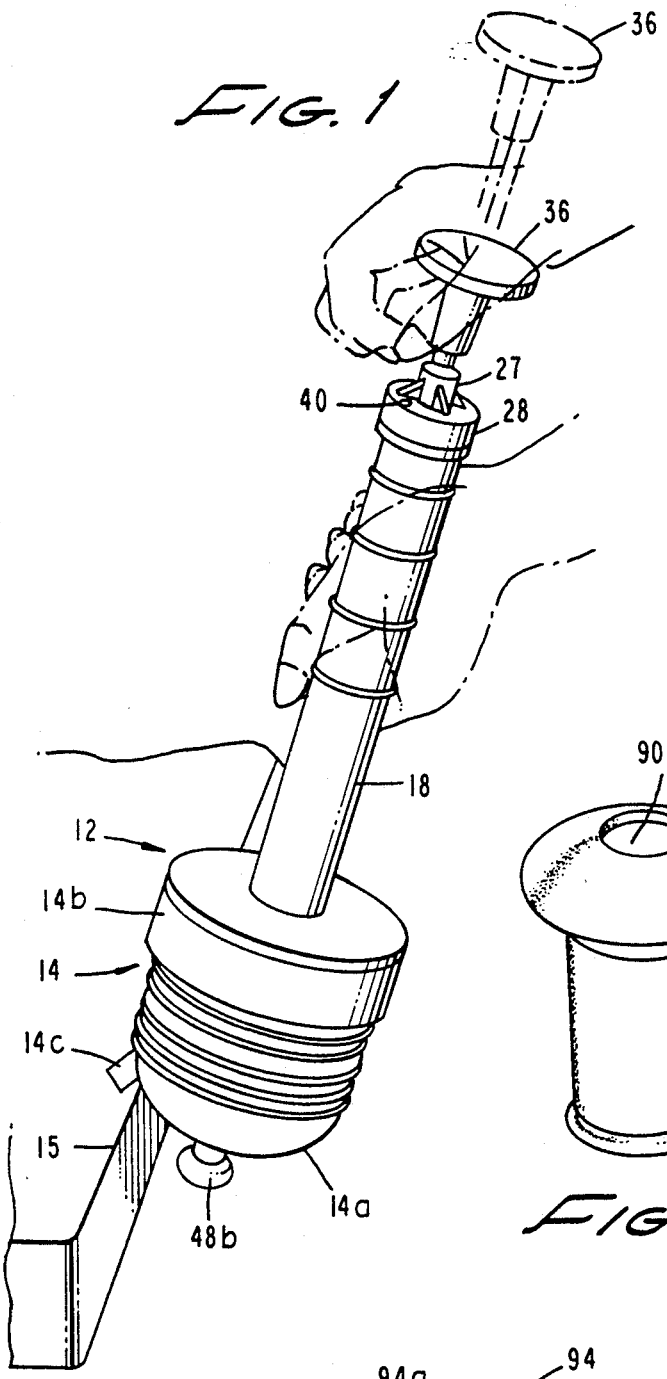
FIG. 1 is a generally perspective, illustrational view of one form of the apparatus of the invention.
Figure 4:
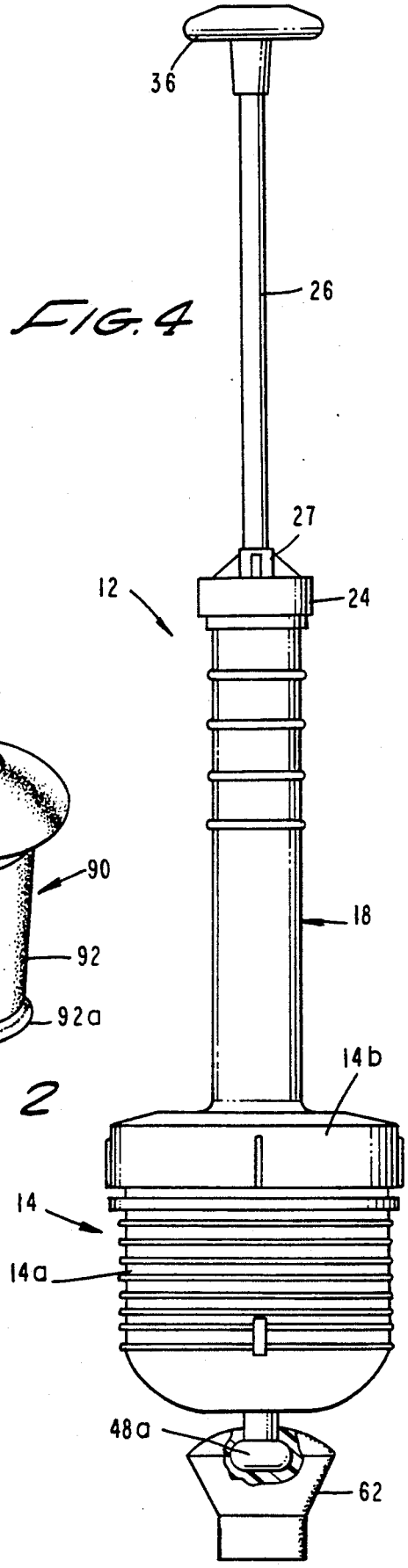
FIG. 4 is a side elevational view of the apparatus shown in FIG. 1, having the drain seal adapter interconnected therewith.
Figure 5:
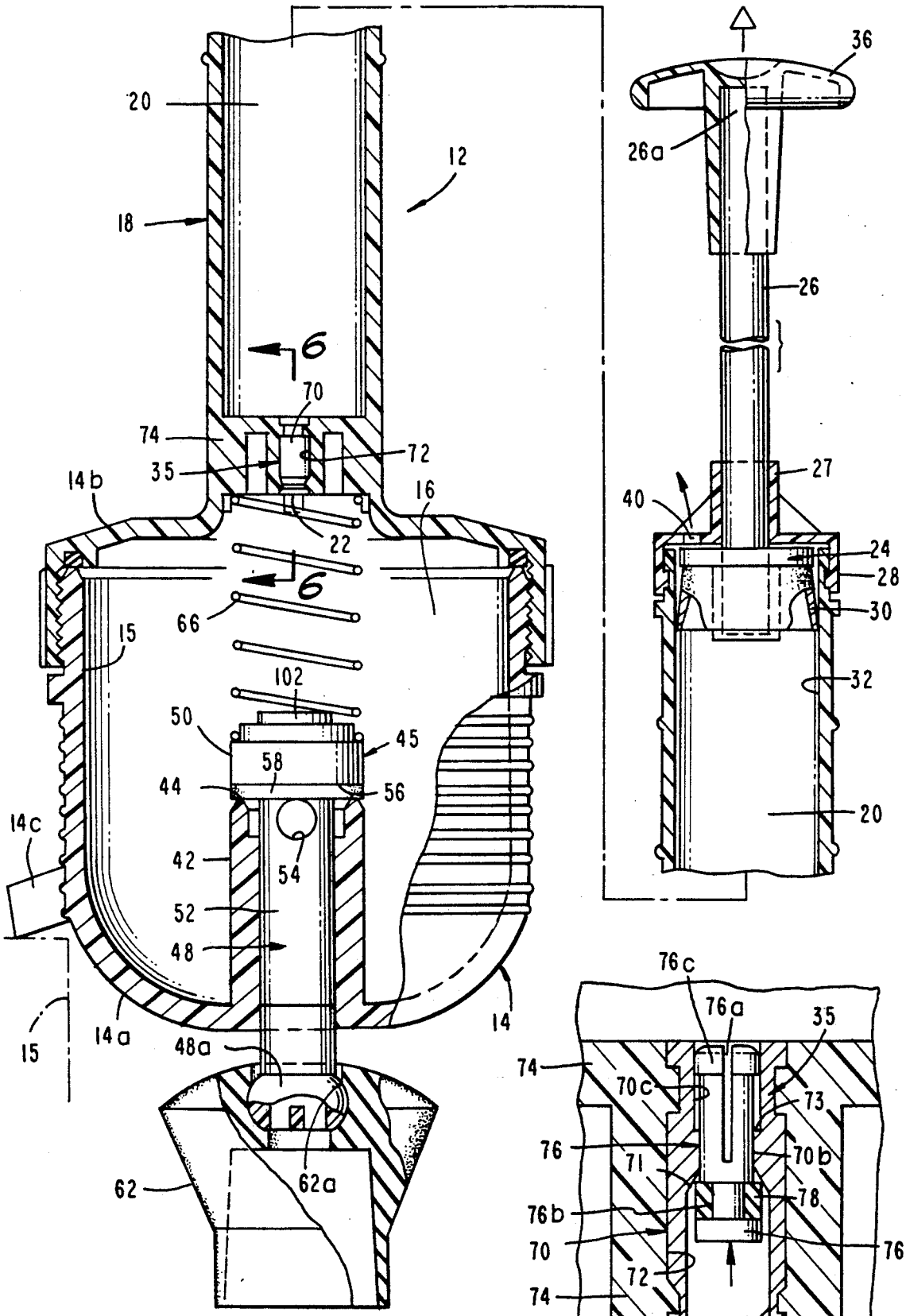
FIG. 5 is an enlarged cross-sectional view of the apparatus of the invention shown in FIG. 4.

Referring to the drawings and particularly to FIGS. 1, 4, and 5, the pneumatic drain clean-out apparatus 12 of the present invention comprises a body portion 14 having inner walls 15 defining an air chamber 16 (FIG. 5). Body portion 14 includes a generally cup-shaped main body 14*a* and a top 14*b* that is threadably interconnected with body 14*a*. Connected to top 14*b* is an outwardly extending tubular section 18 having an elongated inner chamber 20.

Figure 11:
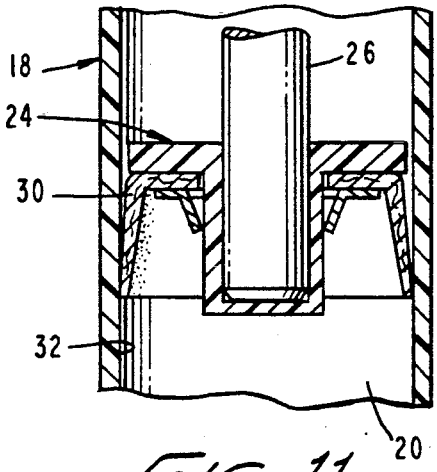
FIG. 11 is an enlarged cross-sectional view taken along lines 11—11 of FIG. 7.

Section 18 comprises a part of the pump means of this form of the invention for controllably introducing air into the inlet 22 of air chamber 16 (FIG. 5). The pump means further comprises a piston assembly which is reciprocally movable within chamber 20 of tubular section 18. The piston assembly in this embodiment of the invention comprises a piston 24 and an elongated actuating rod 26 which is connected at one end to piston 24 in the manner illustrated in FIG. 11. The opposite end 26*a* of rod 26 extends outwardly of chamber 20 through a neck 27 on a closure cap 28 which is interconnected with the upper portion of section 18 in the manner shown in FIG. 5. Piston 24 is provided with a downwardly extending, resiliently deformable skirt 30 which is adapted to sealably engage the inner wall 32 of chamber 20 as the piston assembly reciprocates within chamber 20 from the outwardly extending position shown in FIG. 5 to the downwardly most position shown in FIG. 7. As the piston assembly moves downwardly in the manner illustrated in FIG. 7, air within chamber 20 will be urged into chamber 16 in the manner indicated by the arrows 34 of FIG. 7.

Provided proximate upper end 26*a* of actuating rod 26 is a handle 36 which provides means for easy engagement by one hand of the operator as indicated in FIG. 1. As the piston is moved upwardly in the manner shown in FIG. 5, air within chamber 20 is exhausted to atmosphere through an aperture 40 provided in cap 28.

Disposed intermediate chambers 16 and 20 is a check valve means 35 for permitting air to flow from chamber 20 toward chamber 16 but blocking air flow in the opposite direction. The construction and operation of this check valve means will be described in greater detail in the paragraphs that follow.

As best seen be referring to FIG. 5, body 14 further includes an inwardly extending tubular section 42 which terminates at its upper end in a circumferentially extending valve seat 44. Operably associated with tubular section 42 is a sealing adapter assembly generally designated by the numeral 45. This assembly comprises a generally tubular shaped member 48 which is reciprocally movable within tubular section 42 from the first valve closing position shown in FIG. 5 to the second valve open position shown in FIG. 15. Member 48 includes an enlarged diameter portion 50 and a downwardly depending skirt portion 52 which is provided with an aperture 54, the purpose of which will presently be described.

Figure 12:
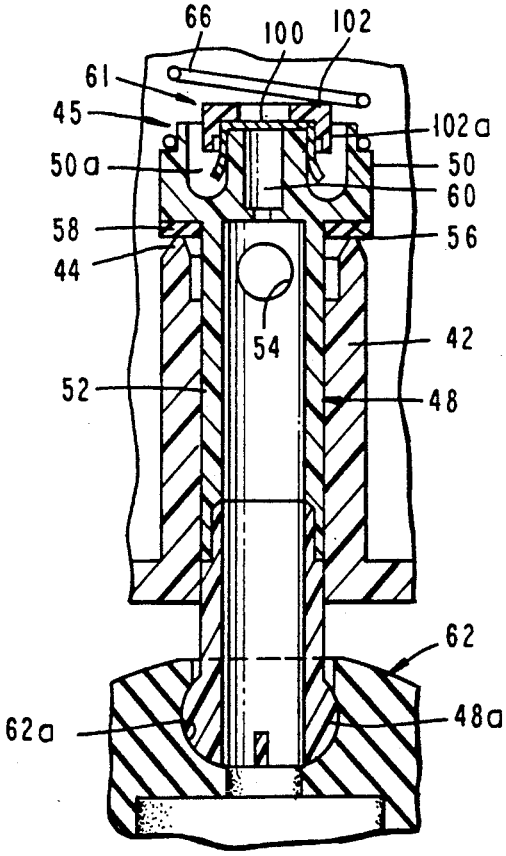
FIG. 12 is an enlarged cross-sectional view taken along lines 12—12 of FIG. 7.

Enlarged diameter portion 50 of member 48 includes a shoulder 56 which operably supports a valve seat sealing means shown here as an elastomeric washer 58. Washer 58 is adapted to sealably engage valve seat 44 in the manner shown in FIG. 5 when the tubular shaped member 48 is in the first valve closing position illustrated in FIG. 5. Referring to FIG. 12, it is to be noted that enlarged diameter portion 50 is provided with an air passageway 60 which extends through portion 50 and communicates with the interior of skirt portion 52 of tubular member 48. An extremely important feature of the apparatus of the present invention comprises a safety pressure relief means 61 which normally closes passageway 60. The character of this safety means will be presently described in detail in the paragraphs which follow.

Figures 14, 15:
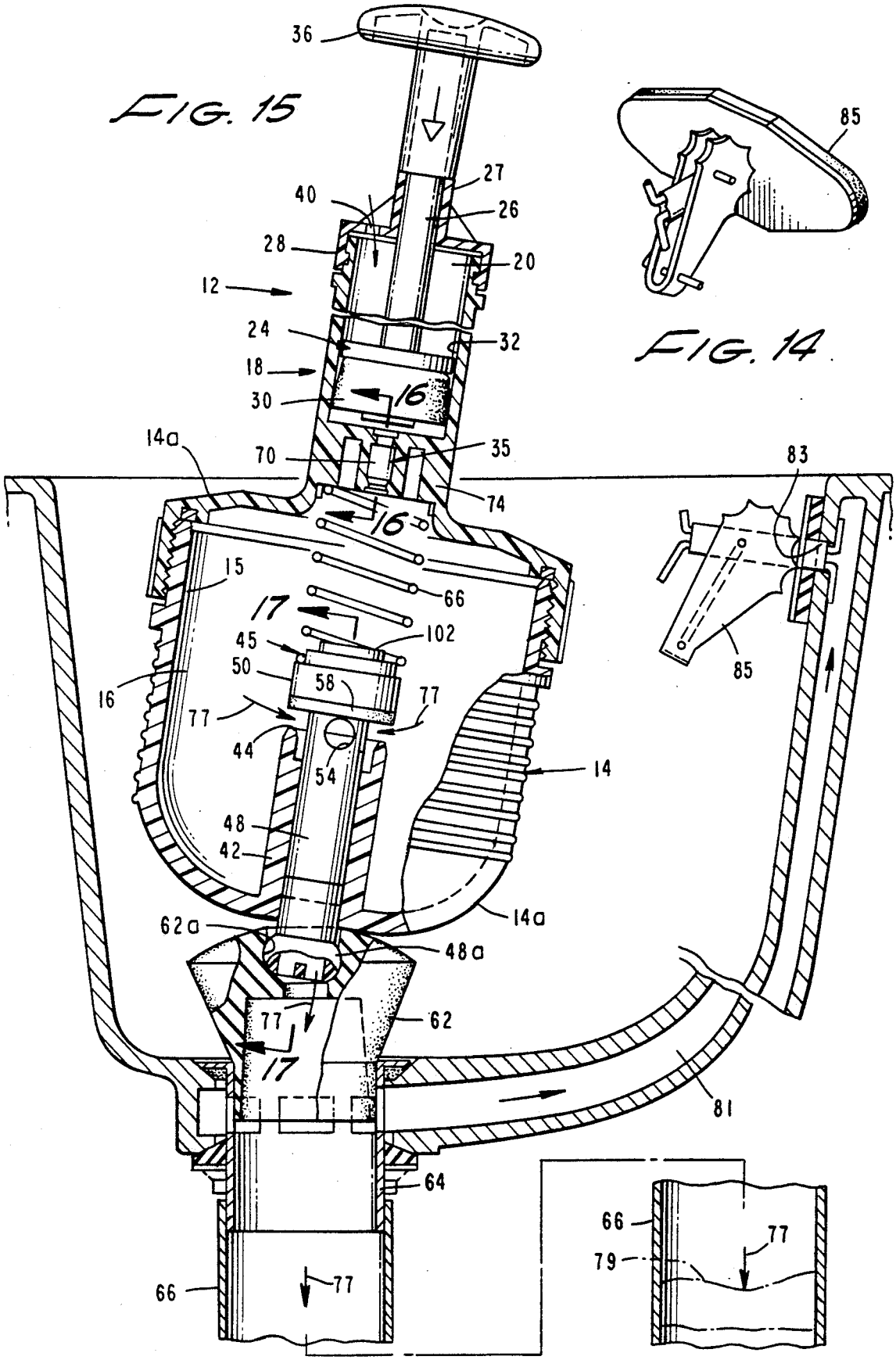
FIG. 14 is a generally perspective view of the overflow sealing apparatus used in connection with the apparatus of the invention.
FIG. 15 is a cross-sectional, diagrammatic view of one form of the apparatus of the invention in an operating position.
Figures 19, 20, 21:
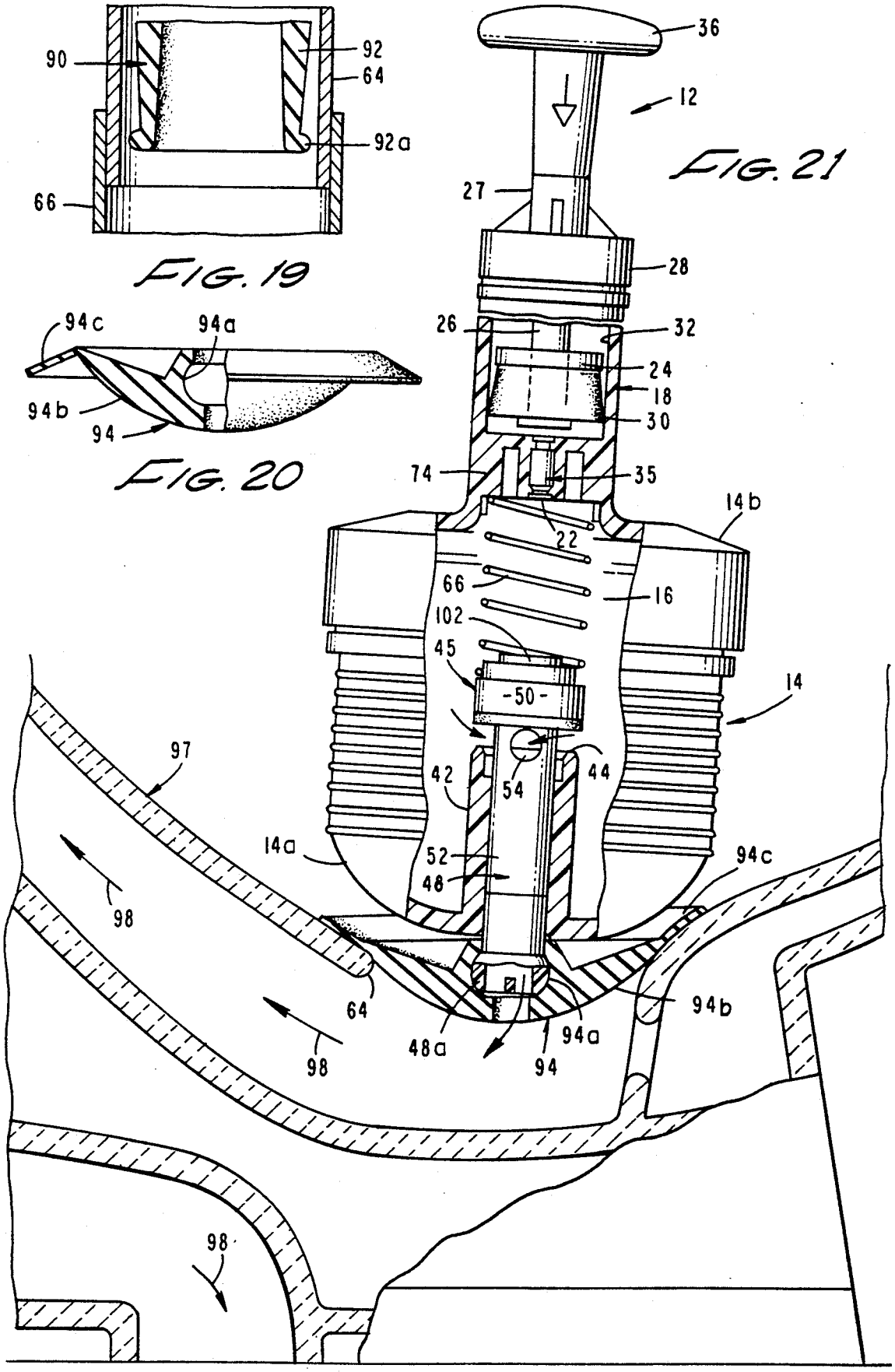
FIG. 19 is an enlarged cross-sectional view of the drain sealing adapter of the form of the invention shown in FIG. 18.
FIG. 20 is a side elevational view, partly in cross-section of the toilet drain sealing adapter of the invention.
FIG. 21 is a side elevational view partly in cross-section of the apparatus of the invention in operating position within a toilet.

The lower or second end of tubular member 48 is generally bulbous in shape and functions as the means to interconnect therewith a drain sealing member 62 with tubular member 48. As indicated in FIG. 15, in one form of the invention, draining sealing member 62 is adapted to be sealably received within an outlet drain 64 of a wash basin. Outlet drain 64 is, in turn, interconnected with the waste line 66 of the domestic waste line system. It is to be understood that the outlet drain 64 may also be the outlet drain of a bathtub or the outlet drain of a toilet (FIG. 21). Drain sealing member 62 is typically constructed of an elastomeric material such as a soft natural or synthetic rubber. The member is provided with a central socket 62*a* which closely removably receives the bulbous end portion 48*a* of tubular member 48.

Disposed intermediate cap 14*b* of body 14 and enlarged diameter portion 50 of tubular member 48 is biasing means for yieldably resisting movement of tubular member 48 from the first position shown in FIG. 5 to the second valve open position shown in FIG. 15. In the embodiment of the invention shown in the drawings, this biasing means is provided in the form of a coiled spring 66.

Figure 6:
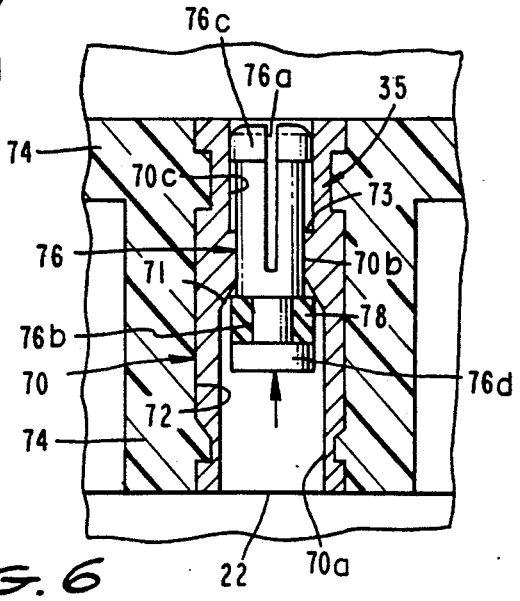
FIG. 6 is an enlarged cross-sectional view taken along lines 6—6 of FIG. 5.
Figures 7, 8:
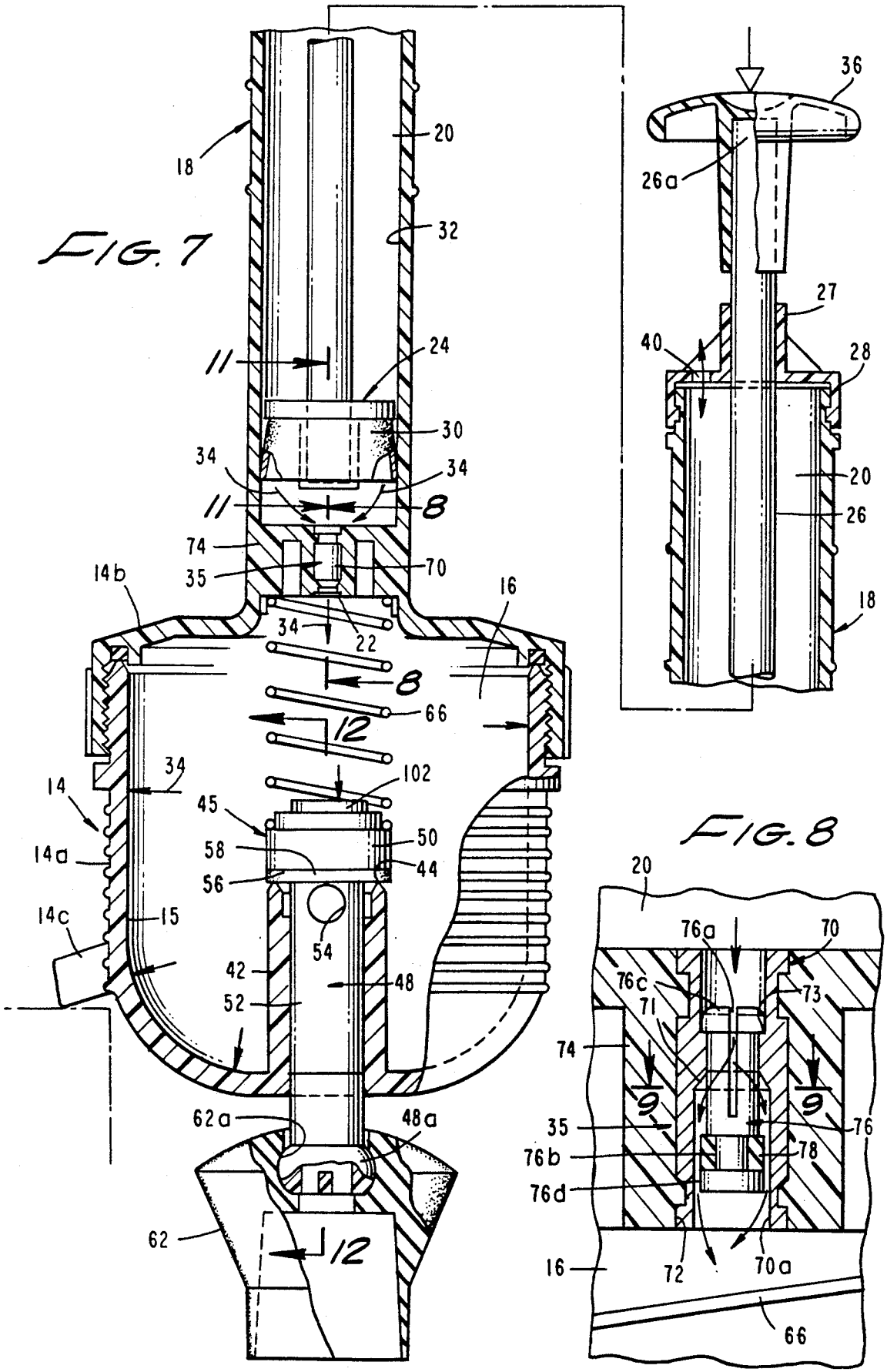
FIG. 7 is an enlarged cross-sectional view similar to FIG. 5, but showing the plunger of the device in a downwardmost, air-chamber pressurizing position.
FIG. 8 is an enlarged cross-sectional view taken along lines 8—8 of FIG. 7 showing the check valve of the device in an open position.
Figure 9:
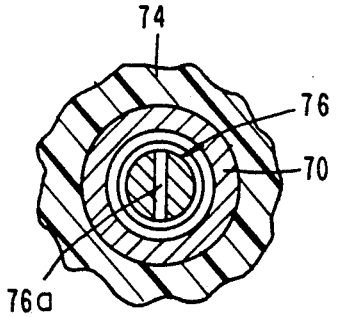
FIG. 9 is a cross-sectional view taken along lines 9—9 of FIG. 8.
Figure 10:
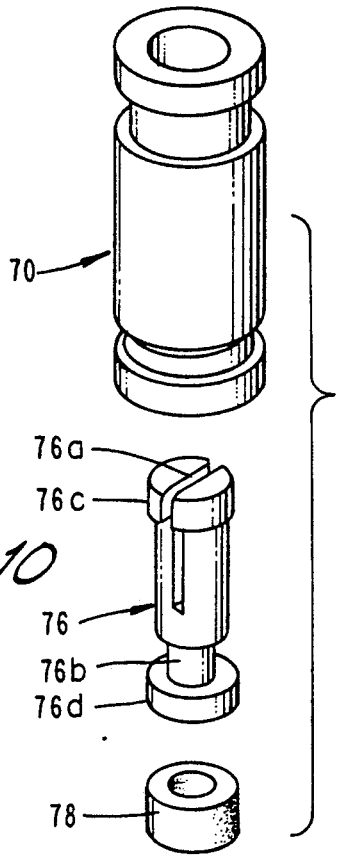
FIG. 10 is an enlarged generally perspective, exploded view of the check valve of the apparatus.
Figure 16:
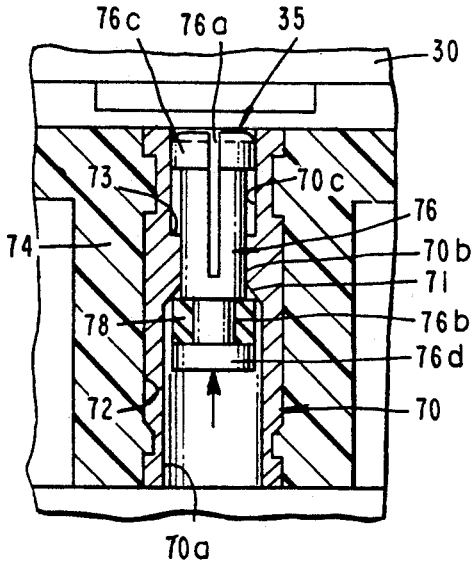
FIG. 16 is an enlarged cross-sectional view taken along lines 16—16 of FIG. 15.

Turning now to FIGS. 6, 9 and 10, the previously mentioned check valve means of the present form of the invention can be seen to comprise a main body portion 70 which is secured within a central bore 72 provided in a transverse wall portion 74 of tubular section 18. As best seen by referring to FIG. 6, body 17 is provided with a central bore 70*a* which includes a necked down portion 70*b* which functions as a valve seat. The upper portion 70*c* of bore 70*a* terminates at its inboard end in a shoulder 73, the purpose of which will presently be described. Reciprocally movable within bore 70*a* is a poppet 76 which includes a centrally slotted portion 76*a* and a reduced diameter portion 76*b*. Poppet member 76 also includes an enlarged diameter head portion 76*c* and an enlarged diameter base portion 76*d*. A sealing member 78 is disposed about reduced diameter portion 76*b* in the manner shown in FIG. 6. Turning also to FIG. 8, it is to be noted that poppet 76 is reciprocally movable from the closed position shown in FIGS. 6 and 16 to the open position shown in FIG. 8 wherein air from chamber 20 is permitted to flow in the direction of the arrows downwardly through slot 76*a*, passed seat 70*b*, and inwardly into air chamber 16. As indicated ty the arrow in FIGS. 6 and 16, air pressure within chamber 16 acts against the poppet in a manner to continuously urge it into the closed position shown in FIGS. 6 and 16 wherein elastomeric member 78 is secured in sealing engagement with valve seat 71 thereby blocking the flow of fluid outwardly of chamber 16 in a direction toward chamber 20.

Figure 17:
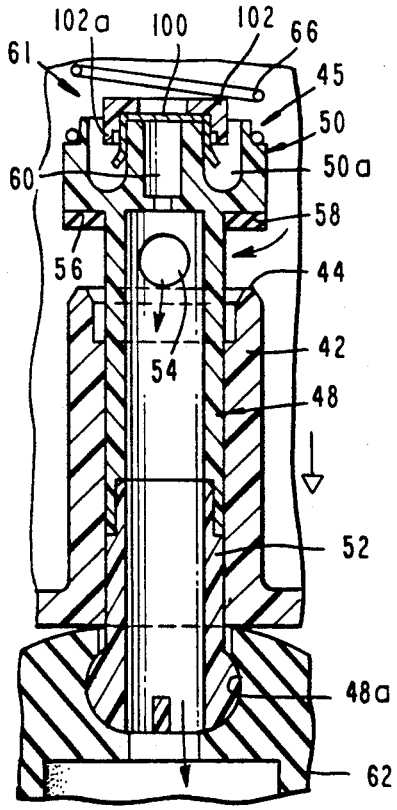
FIG. 17 is an enlarged cross-sectional view taken along lines 17—17 of FIG. 15.

In operating the apparatus of the invention, the drain sealing member 62 is inserted into the outlet drain 64 which leads to the clogged waste line 66. The operator then places the apparatus (tab 14*c*) against an edge surface 15 in the manner then shown in FIG. 1 with tab 14*b* provided on main body 14*a* in engagement with the edge surface 15. Grasping handle 36, the piston assembly is rapidly reciprocated within chamber 20 by pushing and then pulling on handle 36. With each downward pass of piston 24, air within chamber 20 will be forced into chamber 16 past poppet 76 of the check valve means (FIG. 8). After a sufficient pressure build up within chamber 16 has been achieved, the pump structure is mated with the sealing member 62 as shown in FIG. 15 and a final downward force is exerted on handle 36 sufficient to overcome the urging of spring 66. This downward force will cause tubular member 48 to move upwardly witin section 42 in the manner shown in FIGS. 15 and 17. As the tubular member moves upwardly, sealing washer 58 will move away from valve seat 44 permitting air to flow past the valve seat into tubular skirt 52 and then through the central opening in sealing member 62 in the manner indicated by arrows 77 in FIG. 15. This introduction into the clogged waste line of a sudden blast of air under pressure will enter the clogged waste line 66 and loosen the blockage 79 that has formed within the waste line 66.

Upon release of handle 36, spring 66 will automatically urge tubular member 48 downwardly into its normal, valve closing position shown in FIG. 5 so that, if desired, the pumping cycle can be repeated. In instances where the blockage 79 is substantial, several pumping and air blast release cycles may have to be undertaken before the blockage is completely cleared from the waste line.

When the apparatus of the invention is used with a basin of the character shown in FIG. 15 having an overflow passageway 81 and a overflow inlet 83, inlet 83 is conveniently sealed by a sealing apparatus generally designated in the drawings by the numeral 85 (FIG. 14). This overflow sealing apparatus is described in detail in U.S. Pat. No. 5,004,119 issued to the present applicant.

Figure 2:
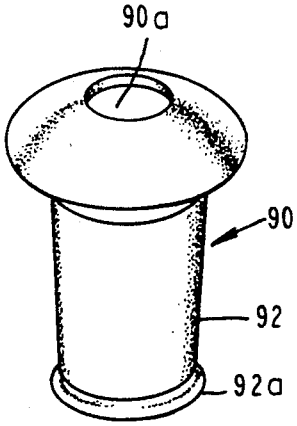
FIG. 2 is a generally perspective view of one form of the wash basin drain sealing adapter of the apparatus of the invention.
Figure 18:
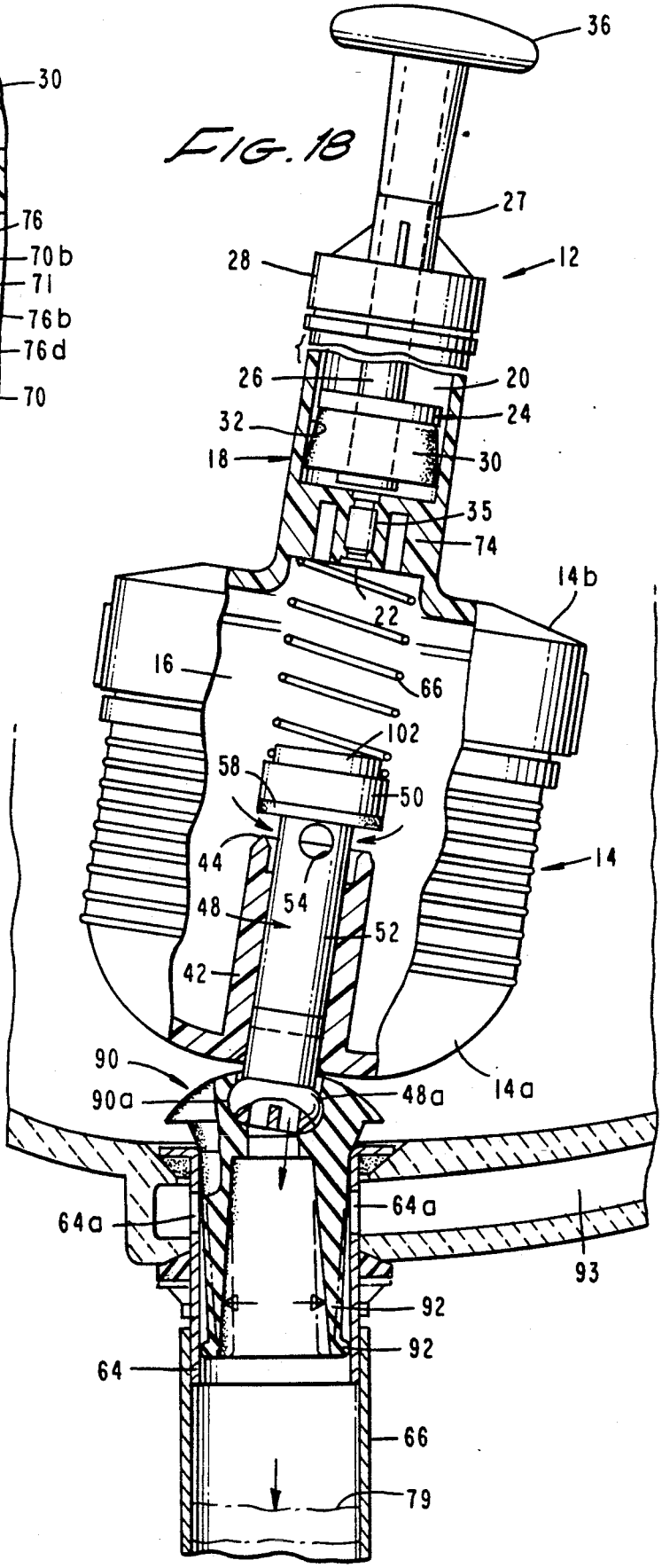
FIG. 18 is a cross-sectional view of one form of the apparatus of the invention in an operating position within a wash basin of a different construction from that shown in FIG. 15.

Turning now to FIGS. 18 and 19, the use of another drain sealing member 90 is illustrated (see also FIG. 2). Member 90 is similar in construction to drain sealing member 62 but includes an elongated skirt portion 92 having an outwardly extending circumferential rib **92*a* which is adapted to sealably engage the inner wall of the outlet drain 64. Adapter 90 is used in connection with wash basins of a design having an overflow drain system which is not easily closable by the drain sealing apparatus 85. When a basin of this character is encountered, the use of adapter 90 provides an effective seal to outlet drain 64 at a location below outlet openings 64*a* so that overflow channels 93 of the wash basin are effectively sealed during the blockage removal operation so that air pressure from the apparatus is not dissapated out the overflow and the full impact of air goes toward the stoppage. Normally users of this type of tool will require special apparatus objects to seal the overflow openings and the drain seal 90 eliminates the need for this procedure. Once again, adapter 90 is preferably made of a resiliently deformable material such as soft rubber or plastic and is configured so that skirt portion 92*a* securely seals against the inner wall of the overflow drain 64 in the manner shown in FIG. 18. A cavity 90*a* is provided for interconnection with bulbous portion 48*a* of member 48. The apparatus of the form of the invention shown in FIG. 18 is operated in the same manner described in the preceding paragraphs save for the fact that adapter 90 uniquely seals the outlet drain so that the use of the separate overflow drain sealing adapter 85** is not required.

Figure 3:
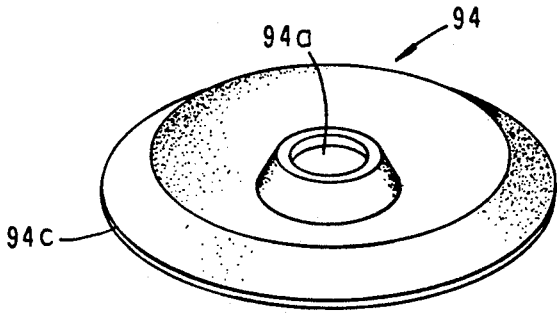
FIG. 3 is a generally perspective view of the toilet drain sealing adapter of the apparatus of the invention.

Turning now to FIGS. 20 and 21 the pumping portion of the apparatus of the invention is there shown being used with a sealing adapter 94 of yet another configuration (see also FIG. 3). Adapter 94 is provided with a centrally disposed cavity **94*a* which closely receives bulbous portion 48*a* of tubular member 48 in the manner best seen in FIG. 31. Drain sealing member 94 is of a generally disk shaped construction having a lower surface 94*b* and circumferential flange 94*c* which are movable into sealing engagement with the outlet drain 64 of a conventional toilet 97 of the character illustrated in FIG. 21. Member 94 is once again preferably constructed of a yieldable deformable resilient material such as plastic or natural or synthetic rubber and is uniquely configured so that a positive seal with the inner toilet wall can be achieved in the manner illustrated in FIG. 21. Once again the apparatus of the invention is used in the same manner as previously described and effectively functions to produce an air blast which enters the drain channels of the toilet in the manner indicated by the arrows 98 of FIG. 21**.

Figure 22:
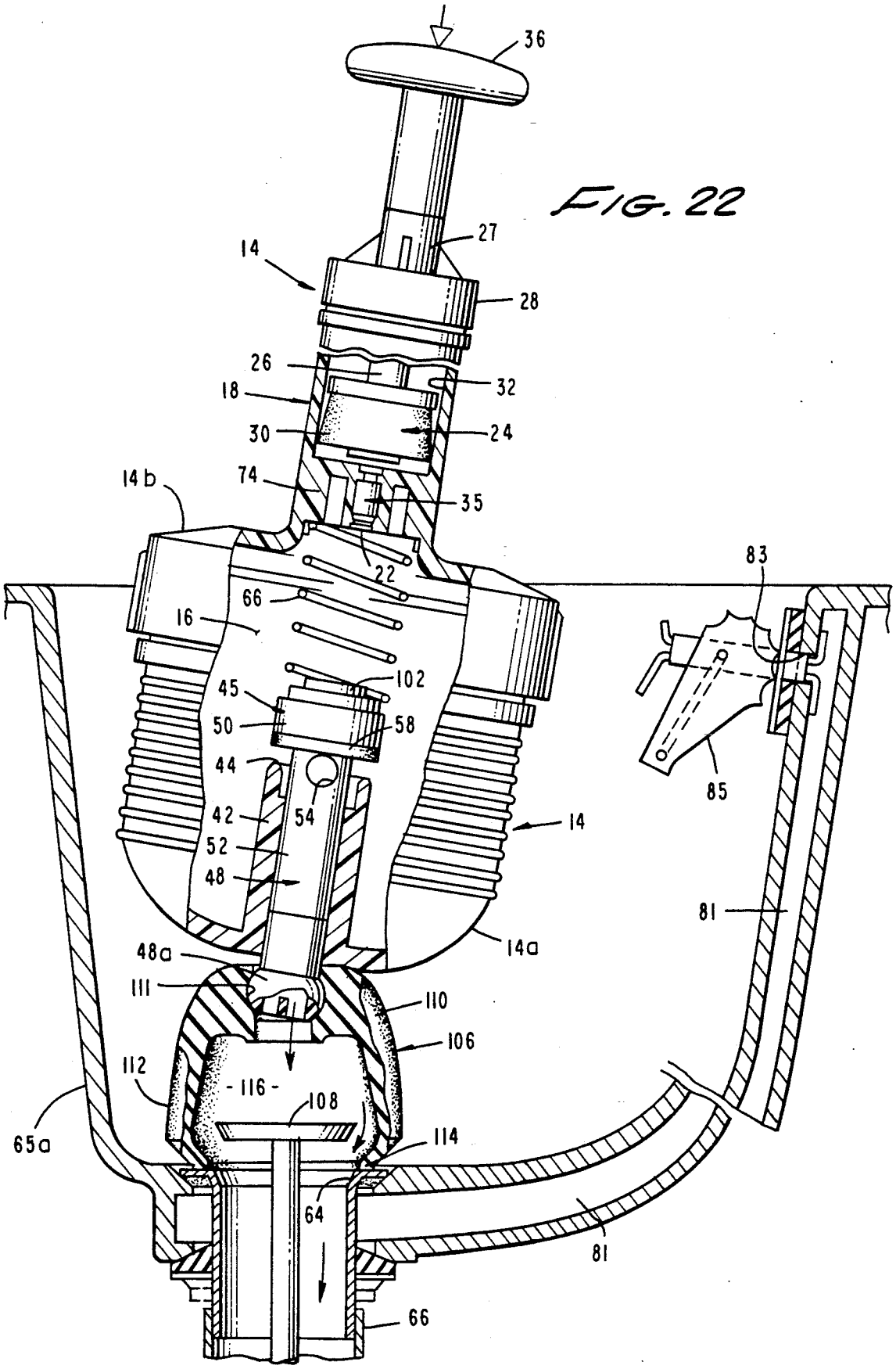
FIG. 22 is a side elevational view partly in cross-section, similar to FIG. 15 of another form of the apparatus of the invention in an operating position.

Referring to FIG. 22, the use of still another type of drain sealing member 106 is illustrated. Member 106 is used in connection with wash basin **65*a* of the character having a permanently installed, pop-up type drain seal 108 which closes the outlet drain 64 when it is in a downward position. The pop-up drain is typically moved into the sink draining position shown in FIG. 22 by pulling upwardly on a pull pin which extends through the top of the sink and is interconnected with a pop-up drain activation disposed below the sink. Sealing member 106 is generally bulbous in shape having an upper portion 110 and a downwardly depending skirt portion 112 which terminates in a drain sealing edge portion 114 adapted to sealably engage the outlet drain 64. Member 106 includes an internal chamber 116 which is of sufficient size to receive the sink pop-up 108 when it is in the raised basin draining position shown in FIG. 22. Upper portion 110 is provided with a cavity 111 which closely receives portion 48*a* of tubular member 48**.

The apparatus of the form of the invention shown in FIG. 22 is operated in the same manner described in the preceding paragraphs with the separate overflow drain sealing adapter 85 being used to seal the basin overflow ports.

Figure 13:
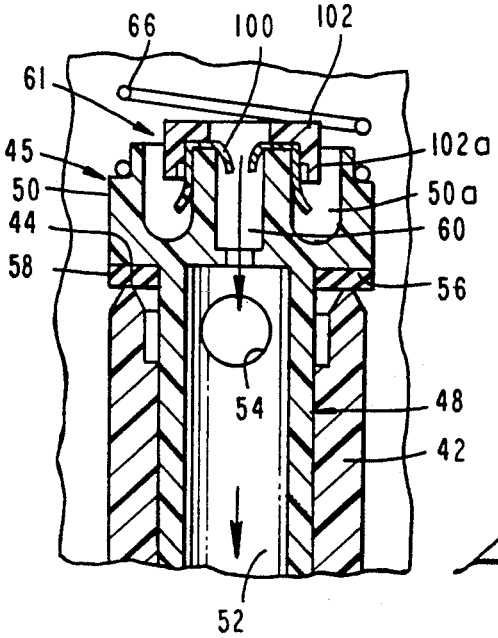
FIG. 13 is an enlarged cross-sectional view similar to FIG. 12, but showing the air chamber safety pressure means of the apparatus in a ruptured, air venting configuration.

Turning now to FIGS. 12 and 13, the previously mentioned, highly important safety pressure release means of the invention is there illustrated. In this embodiment of the invention, this means comprises a frangible diaphragm 100 which overlays passageway 60 and functions to normally prevent the flow of air through the passageway from chamber 16 to atmosphere. Frangible diaphragm 100 can be constructed of a number of materials including thin metal, plastic or like rupturable membranes. Diaphragm 100 is held in position over enlarged diameter portion 50 by an annular shaped cap 102 having a peripheral flange **102*a* which is receivable within a groove 50*a* provided in portion 50**.

Diaphragm 100 is uniquely designed so that when pressure within chamber 16 reaches a predetermined level, the diaphragm will fail in the manner shown in FIG. 13. Upon failure of the diaphragm, air under pressure within chamber 60 will flow to atmosphere in the manner indicated by the arrows in FIG. 13. The failure pressure of diaphragm 100 is substantially less than the failure pressure of body 14. With this construction, if the operator inadvertantly overpressurizes chamber 16, diaphragm 100 will fail well prior to failure of the walls of body 14 and the air within the chamber will be harmlessly vented to atmosphere. This unique feature is not present in the prior art devices.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A pneumatic drain clean-out apparatus for removing blockages within waste lines, comprising:

(a) a body portion having an air chamber with an air inlet and including an inwardly extending tubular section terminating in a valve seat;

(b) pump means connected to said body portion for controllably introducing air into said air chamber;

(c) a check valve disposed intermediate said pump means and said air inlet of said air chamber;

(d) a sealing adapter assembly connected to said body portion, said assembly comprising:

(i) a generally tubular shaped member reciprocally movable within said inwardly extending tubular section of said body portion between first and second positions, said member having an air passageway therethrough between first and second ends, said first end comprising an enlarged diameter portion having a shoulder disposed proximate said valve seat and adapted to sealingly engage therewith;

(ii) a drain sealing member connected to said second end of said tubular shaped member for sealable engagement with the inlet of the waste line; and (iii) safety pressure relief means for normally closing said air passageway adjacent said enlarged diameter portion of said tubular member and for opening said air passageway upon pressure within said air chamber reaching a predetermined level; and (e) biasing means disposed within said air chamber for yieldably resisting movement of said tubular shaped member from said first to said second position.

2. An apparatus as defined in claim 1 in which said safety pressure relief means comprises a frangible diaphragm overlaying said air passageway of said enlarged diameter portion of said tubular member.

3. An apparatus as defined in claim 1 in which said drain sealing adapter assembly further includes sealing means supported by said shoulder of said enlarged diameter portion of said tubular member for sealable engagement with said valve seat when said tubular shaped member is in said first position.

4. An apparatus as defined in claim 3 in which said tubular member is movable from said first position to said second position by exertion of a downward force on said body portion, whereby said sealing means is moved out of sealable engagement with said valve seat.

5. An apparatus as defined in claim 4 in which said sealing means comprises an elastomeric washer disposed between said valve seat and said shoulder of said enlarged diameter portion of said tubular shaped member.

6. An apparatus as defined in claim 4 in which said pump means comprises an upstanding tubular section connected to said body portion and a piston reciprocally movable within said upstanding tubular member.

7. A pneumatic drain clean-out apparatus for removing blockages within waste lines, comprising:

(a) a body portion having an inner wall defining an air chamber with an air inlet and including an inwardly extending tubular section terminating in a valve seat;

(b) an outwardly extending tubular section connected to said body portion;

(c) a piston assembly reciprocally movable within said outwardly extending tubular section, said piston assembly comprising a piston and an elongated actuating rod connected at one end to said piston and having an opposite end protruding at its opposite end from said upwardly extending tubular section;

(d) a check valve disposed intermediate said piston and said air inlet of said air chamber;

(e) a sealing adapter assembly operably associated with said body portion, said assembly comprising:

(i) a generally tubular shaped member reciprocally movable within said inwardly extending tubular section of said body portion between first and second positions, said member having an air passageway therethrough between first and second ends, said first end comprising an enlarged diameter portion having a shoulder disposed proximate said valve seat and adapted to sealingly engage therewith;

(ii) an elastomeric sealing means supported by said shoulder for sealable engagement with said valve seat;

(iii) a drain sealing member removably connected to said second end of said tubular shaped member for sealable engagement with the inlet of the waste line; and (iv) safety pressure relief means for normally closing said air passageway adjacent said enlarged diameter portion of said tubular member and for opening said air passageway upon pressure within said air chamber reaching a predetermined level; and (f) biasing means disposed within said air chamber for yieldably resisting movement of said tubular shaped member from said first to said second position.

8. An apparatus as defined in claim 7 in which said safety pressure relief means comprises a frangible diaphragm overlaying said air passageway of said enlarged diameter portion of said tubular member.

9. An apparatus as defined in claim 7 in which said biasing means comprises a coiled spring disposed intermediate said inner wall of said body portion and said enlarged diameter portion of said tubular shaped member.

10. An apparatus as defined in claim 9 in which said tubular member is movable from said first position to said second position by exertion of a downward force on said actuating rod, whereby said elastomeric sealing means is moved out of sealable engagement with said valve seat.

11. An apparatus as defined in claim 10 in which said elastomeric sealing means comprises an elastomeric washer disposed between said valve seat and said shoulder of said enlarged diameter portion of said tubular shaped member.

12. A pneumatic drain clean-out apparatus for removing blockages within waste lines connected to an outlet drain, comprising:

(a) a body portion having an inner wall defining an air chamber with an inlet and an outlet and including an inwardly extending tubular section terminating in a valve seat;

(b) an outwardly extending tubular section connected to said body portion;

(c) a piston assembly reciprocally movable within said outwardly extending tubular section, said piston assembly comprising a piston and an elongated actuating rod connected at one end to said piston and having an opposite end protruding from said upwardly extending tubular section;

(d) a check valve disposed intermediate said piston and said air inlet of said air chamber;

(e) a sealing adapter assembly operably associated with said body portion, said assembly comprising:

(i) a generally tubular shaped member reciprocally movable within said inwardly extending tubular section of said body portion between first and second positions, said member having an air passageway therethrough between first and second ends, said first end comprising an enlarged diameter portion having a shoulder disposed proximate said valve seat and adapted to sealingly engage therewith;

(ii) an elastomeric washer supported by said shoulder for sealable engagement with said valve seat when said tubular member is in said first position;

(iii) a drain sealing member removably connected to said second end of said tubular shaped member for sealable engagement with the inlet of the waste line; and (iv) safety pressure relief means for normally closing said air passageway adjacent said enlarged diameter portion of said tubular member and for opening said air passageway upon pressure within said air chamber reaching a predetermined level, said safety pressure relief means comprising a frangible membrane sealably fitted over said air passageway of said enlarged diameter portion of said tubular member; and (e) a coiled spring disposed between said inner wall, said air chamber and said enlarged diameter portion of said tubular member for yieldably resisting movement of said tubular member from said first to said second position.

13. An apparatus as defined in claim 12 in which said tubular member is movable from said first position to said second position by exertion of a downward force on said actuating rod, whereby said elastomeric washer is moved out of sealable engagement with said valve seat.

14. An apparatus as defined in claim 13 in which said drain sealing member comprises a body portion removably receivable over said second end of said tubular shaped member and a skirt portion adapted to sealably engage said outlet drain.

15. An apparatus as defined in claim 13 in which said drain sealing member comprises an elastomeric, generally disk shaped member adapted to sealably engage said outlet drain.

16. A pneumatic drain clean-out apparatus for use in connection with wash basins having a pop-up type drain seal for removing blockages within waste lines connected to the wash basin comprising:

(a) a body portion having an air chamber with an air inlet and including an inwardly extending tubular section terminating in a valve seat;

(b) pump means connected to said body portion for controllably introducing air into said air chamber;

(c) a check valve disposed intermediate said pump means and said air inlet of said air chamber;

(d) a sealing adapter assembly connected to said body portion, said assembly comprising:

(i) a generally tubular shaped member reciprocally movable within said inwardly extending tubular section of said body portion between first and second positions, said member having an air passageway therethrough between first and second ends, said first end comprising an enlarged diameter portion having a shoulder disposed proximate said valve seat and adapted to sealingly engage therewith;

(ii) a drain sealing member connected to said second end of said tubular shaped member for sealable engagement with the inlet adjacent the waste line, said drain sealing member having an internal chamber for receiving the pop-up drain seal when the drain seal is in a wash basin draining position; and (iii) safety pressure relief means for normally closing said air passageway of said enlarged diameter portion of said tubular member and for opening said air passageway upon pressure within said air chamber reaching a predetermined level; and (e) biasing means disposed within said air chamber for yieldably resisting movement of said tubular shaped member from said first to said second position.

17. An apparatus as defined in claim 16 in which said drain sealing member comprises a body portion removably receivable over said second end of said tubular shaped member, a skirt portion having a lower surface adapted to sealably engage said outlet drain, said skirt portion circumscribing said internal chamber.

18. An apparatus as defined in claim 17 in which said lower surface of said skirt portion comprises an elastomeric, yieldably deformable portion adapted to sealably engage said outlet drain.

* * * * *